US007832349B2

(12) United States Patent
Dansie

(10) Patent No.: US 7,832,349 B2
(45) Date of Patent: Nov. 16, 2010

(54) HYDROFOIL BLADE GUARD

(76) Inventor: Stephen W. Dansie, 619 W. Sandy Pkwy., Sandy, UT (US) 84070

( * ) Notice: Subject to any disclaimer, the term of this patent is extended or adjusted under 35 U.S.C. 154(b) by 189 days.

(21) Appl. No.: 12/126,297

(22) Filed: May 23, 2008

(65) Prior Publication Data

US 2008/0289562 A1 Nov. 27, 2008

Related U.S. Application Data

(60) Provisional application No. 60/940,228, filed on May 25, 2007.

(51) Int. Cl.

| | |
|---|---|
| ***B63B 17/00*** | (2006.01) |
| ***B63B 17/02*** | (2006.01) |
| *B63B 1/24* | (2006.01) |
| *B63B 1/26* | (2006.01) |

(52) U.S. Cl. ..... 114/361; 114/274

(58) Field of Classification Search ..... 114/271, 114/274, 39.12, 39.13, 39.15, 361; 441/65, 441/68, 74, 79

See application file for complete search history.

(56) References Cited

U.S. PATENT DOCUMENTS

| | | | | |
|---|---|---|---|---|
| 2,751,612 | A * | 6/1956 | Harwood | 441/68 |
| 3,018,749 | A * | 1/1962 | De Beurs | 114/126 |
| 3,121,890 | A * | 2/1964 | Rumsey, Jr. | 441/70 |
| 3,480,894 | A * | 11/1969 | Joyce | 335/303 |
| 3,727,416 | A * | 4/1973 | Gaisenok et al. | 405/1 |
| 4,268,078 | A * | 5/1981 | Nomura et al. | 293/120 |

* cited by examiner

*Primary Examiner*—Daniel V Venne
(74) *Attorney, Agent, or Firm*—Bateman IP Law Group

(57) ABSTRACT

A foil guard for sporting devices having hydrofoils covers the exposed edges of the foils and thereby prevents damage to persons or property from accidental contact with the foils. The guard may include cords or elastics to secure the guard to the foils, and may float in water to prevent loss of the guard.

20 Claims, 11 Drawing Sheets

HYDROFOIL BLADE GUARD

RELATED APPLICATIONS

The present application claims the benefit of U.S. Provisional Application Ser. No. 60/940,228, filed May 25, 2007, which is expressly incorporated herein in its entirety.

BACKGROUND OF THE INVENTION

1. The Field of the Invention

The present invention relates to sporting goods. More specifically, the present invention relates to a blade guard for the blades of a hydrofoil stunt chair used in waterskiing.

2. State of the Art

Waterskiing and water sports have become a popular past time. Many persons own a ski boat and participate in activities such as waterskiing, wake boarding, etc. Recently, hydrofoils have been attached to water skis or similar devices for use in a sitting or standing position. The hydrofoil devices which provide seats for the rider are known as "air chairs" or "sky skis." These devices use a small ski with a chair or seat for sitting and a hydrofoil mounted below the ski. Alternatively, devices exist which are similar to a surf board with a hydrofoil mounted below the board and these devices are used in a standing position. The hydrofoil lifts some or all of the board out of the water during use. These devices have developed an alternative sport to waterskiing which is known as hydrofoiling. Air chairs are used for performing stunts while being pulled behind a waterskiing boat.

Air chairs are problematic in that they are rather large and consume a large amount of space when not in use. As such, they may often be placed on a seat or other location in the boat where the air chair may damage the boat, as the hydrofoil blade edges are sharp enough to cause damage to surrounding objects. Additionally, persons may be injured when moving around the air chair if they bump their legs into the chair or otherwise accidentally contact the air chair.

There is thus a need for a protective guard which covers the foils, or blades, of these hydrofoil sporting devices and which reduces the damage to the blades, the boat, and the persons around the air chair.

SUMMARY OF THE INVENTION

It is an object of the present invention to provide an improved blade guard for an air chair.

According to one aspect of the invention, a blade guard is provided which covers the sharp edges of the air chair foils, the winglets upon which the air chair rides. According to another aspect of the invention, a blade guard is provided which floats so as to prevent loss in the event that the blade guard falls into the water. According to another aspect of the invention, a blade guard is provided which is elastomeric in nature.

These and other aspects of the present invention are realized in a hydrofoil blade guard as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
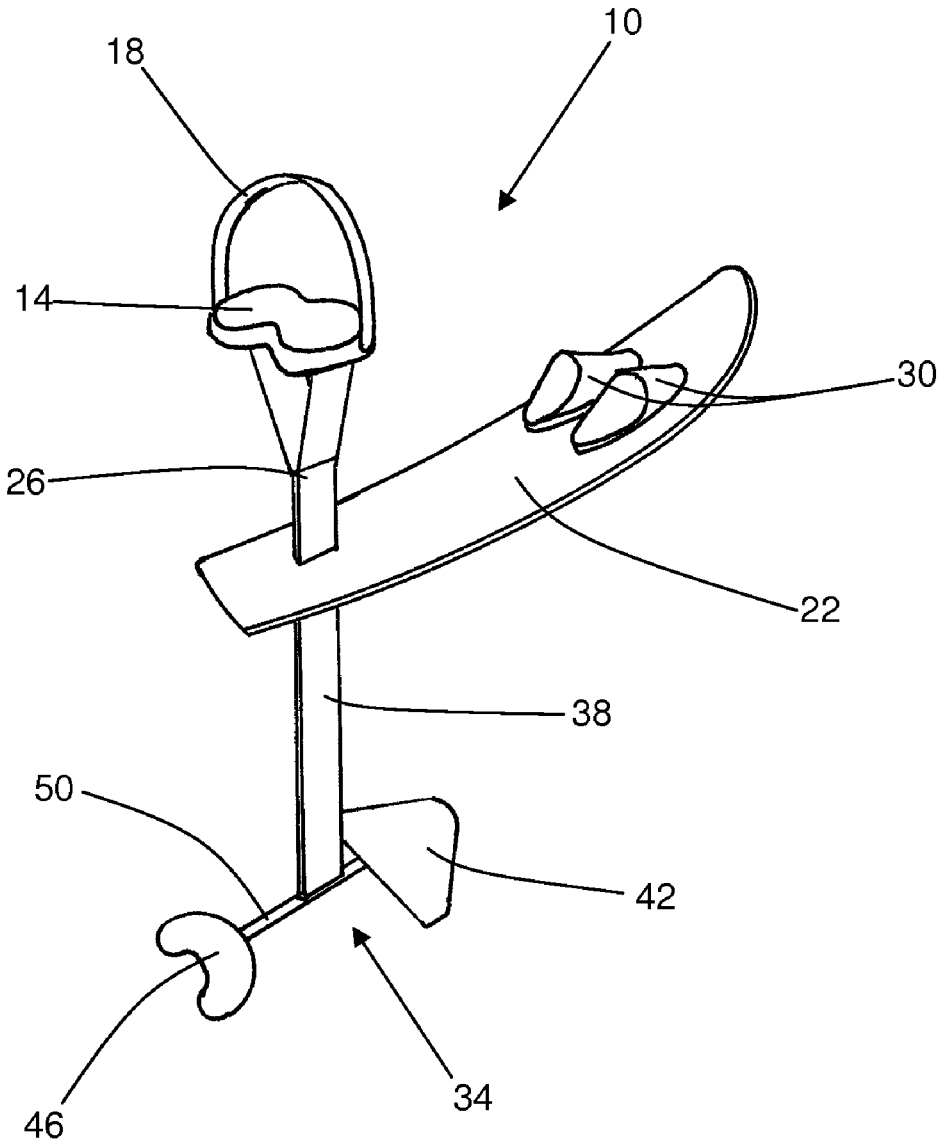
FIG. 1 (Prior Art)
FIG. 1 shows a perspective view of a water sporting device having a hydrofoil as is known in the prior art.

Turning now to FIG. 1, a perspective view of a hydrofoil chair 10, or hydrofoil watersports device, according to the prior art is shown. The chair 10 includes a seat 14 and a seat belt type retaining strap 18 which are attached to a ski 22 via a seat post 26. The ski 22 includes recesses 30 to receive a user's feet. A hydrofoil portion 34 is attached to the ski 22 via a post 38. The hydrofoil portion 34 typically includes a front foil 42 and a rear foil 46, which may be formed to various different shapes. Herein, the foils 42, 46 may be alternatively referred to as foils or blades. The foils 42, 46 are typically connected to each other and to the post 38 by a horizontal beam 50. The edges of the foils 42, 46 are typically fairly sharp to allow them to move easily through the water.

In addition to chair type hydrofoils, standing hydrofoils are available, and differ primarily in the lack of a seat 14 and the placement of the foot recesses 30. The foils 42, 46 on a standing hydrofoil are similar to those shown and the foil guards of the present invention will be equally applicable to such.

Figure 2:
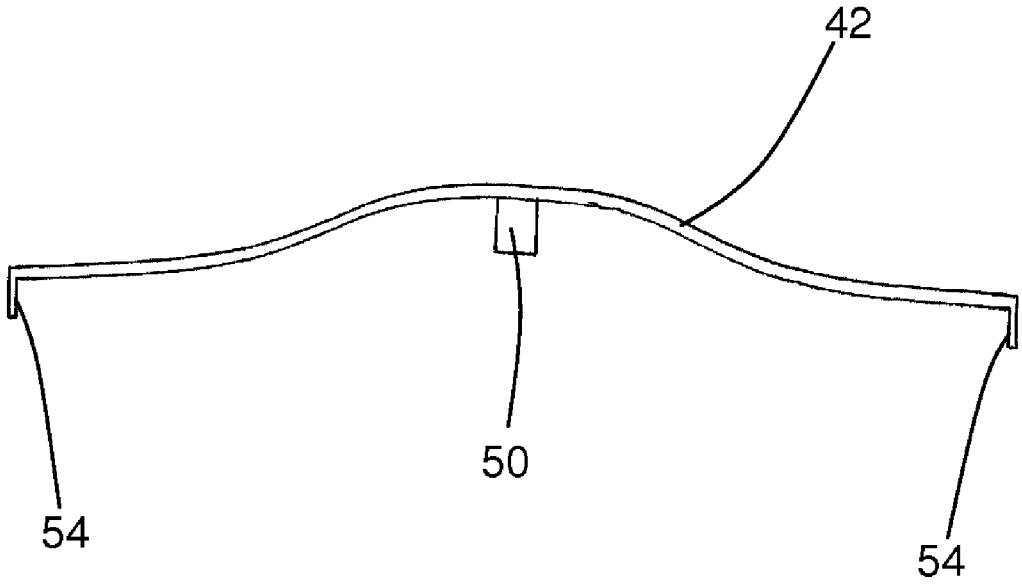
FIG. 2 (Prior Art)
FIG. 2 shows an end view of the front foil of the device of FIG. 1.

FIG. 2 shows an end view of the back of front foil 42 and beam 50 of FIG. 1. Commonly, the foil 42 is curved across the center as shown, and includes rudder-like winglets 54 at the tips of the foil.

Figure 3:
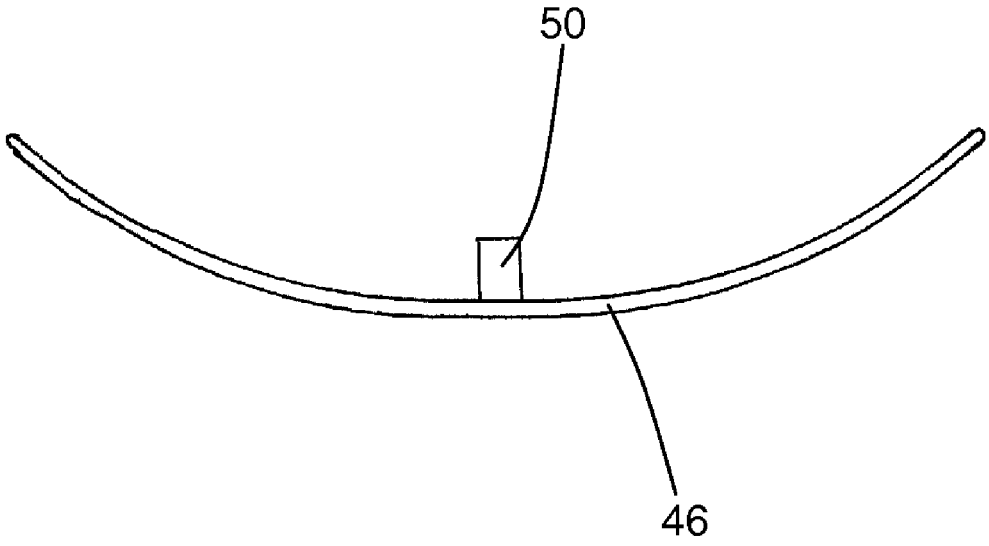
FIG. 3 (Prior Art)
FIG. 3 shows an end view of the rear foil of the device of FIG. 1.

FIG. 3 shows an end view of the back of the rear foil 46 and beam 50 of FIG. 1. The design of the rear foil 46 varies more than the front foil 42. The rear foil 46 of FIG. 1 is typically curved as shown in FIG. 3.

Figure 4:
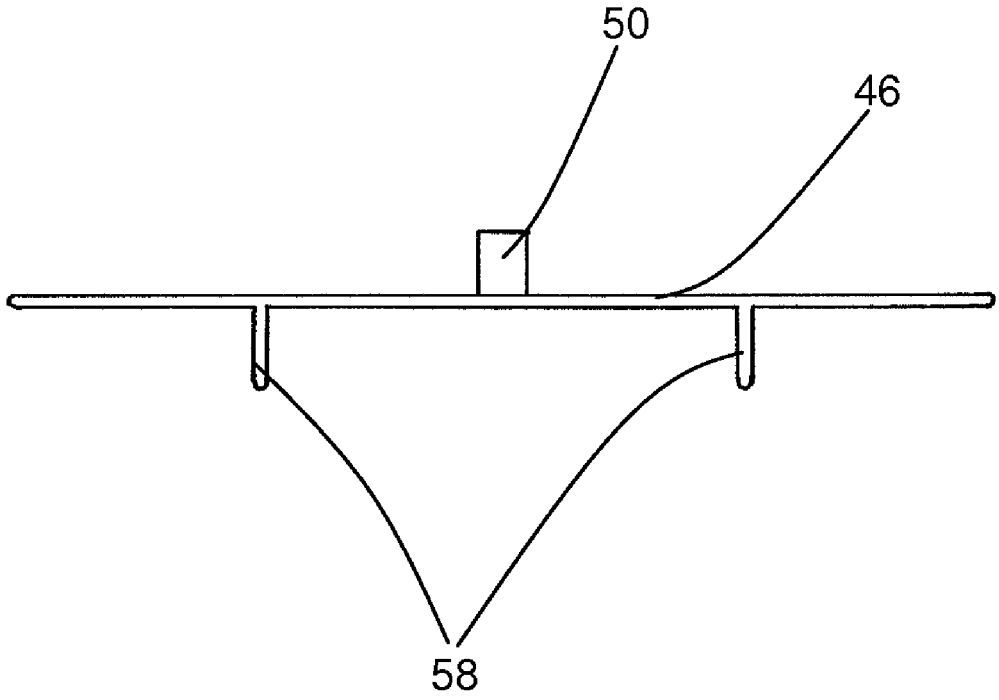
FIG. 4 (Prior Art)
FIG. 4 shows an end view of an alternate rear foil for the device of FIG. 1.

FIG. 4 shows a back view of an alternate shape of the rear foil 46. As shown, the rear foil 46 may be formed with rudders 58 extending from the foil 46. The rear foil 46 shown typically has a triangular shape when viewed from above, as shown in FIG. 5.

Figure 5:
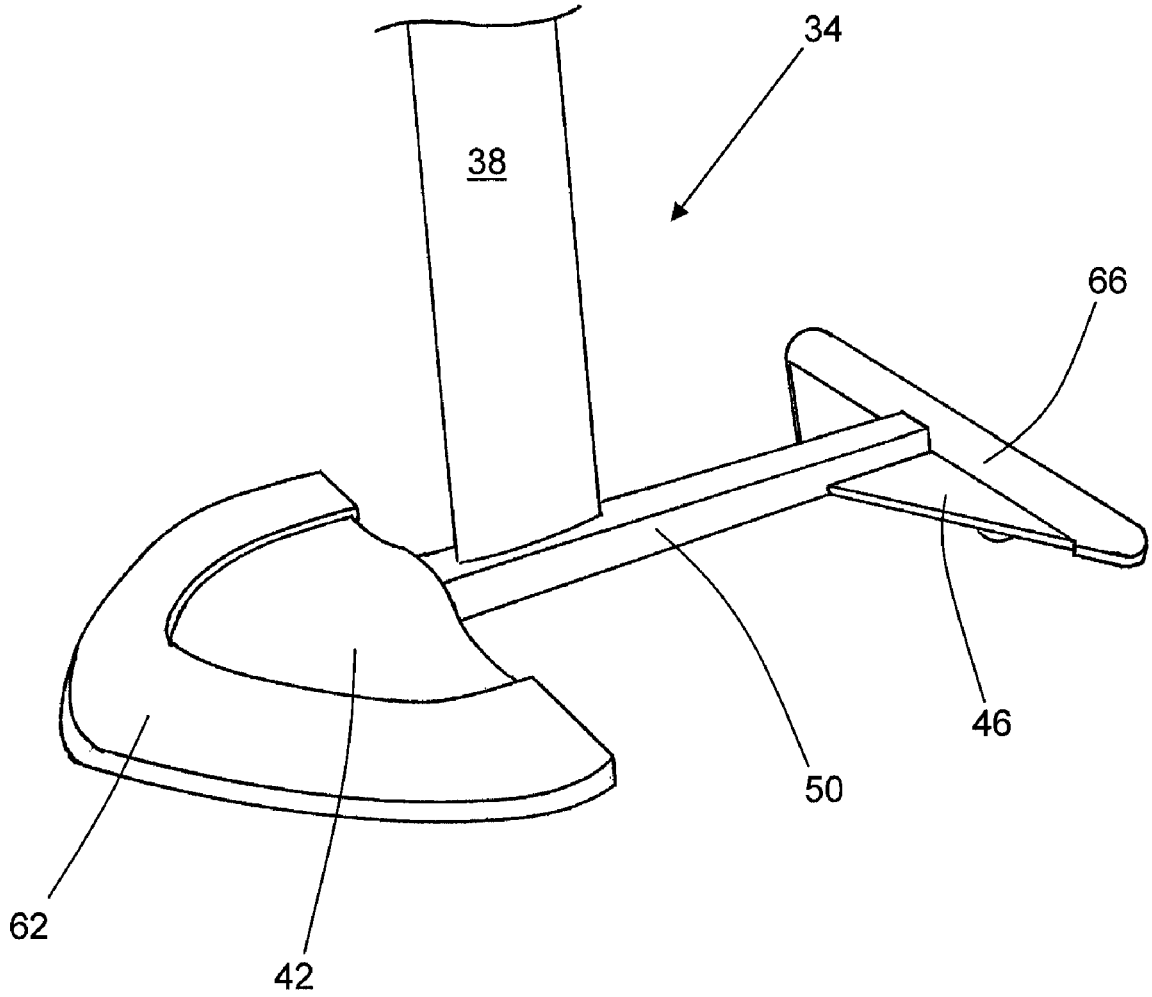
FIG. 5 shows a perspective view of the device of FIG. 1 having guards according to the present invention.

Turning now to FIG. 5, a perspective view of the hydrofoil portion 34 of the device of FIG. 1 is shown having the foil guards of the present invention. The rear foil, or rear hydrofoil blade, 46 is the foil design shown in FIG. 4. The guards may include a front guard 62 which covers much or all of the edges of the front foil, or front hydrofoil blade, 42. A front guard 62 which covers the front, sides, and the outside portions of the rear of the front foil, or hydrofoil blade, 42 will protect the edges of the foil which may be commonly bumped into or which may accidentally contact other objects. It can be seen how the front guard 62 covers a portion of the top surface and bottom surface of the front hydrofoil blade 42. It can also be seen how the front guard 62 is generally V shaped to cover the forward facing edges; the front and side edges of the front hydrofoil blade 42. Similarly, a rear guard 66 may cover the rear edges and corners of the rear foil, or hydrofoil blade, 46 and protect from nearly all accidental collisions with the foil. It can be seen how the rear guard 66 covers a portion of the top surface and bottom surface of the rear hydrofoil blade 46, and how the rear guard 66 is generally straight to cover the rear edge of the rear hydrofoil blade 46. It can be seen how the front guard 62 and rear guard 66 cover portions of the outer edges of the front and rear hydrofoil blades 42, 46.

In discussing the foil guards of the present invention, different shaped guards are shown to accommodate the different shapes of hydrofoil blades. In the various figures, several secondary features such as tethers, flotation devices, elastic cords, etc. are shown. In order to more clearly present the invention and to avoid the presentation of an overly large number of drawings, each particular shape of blade guard is not shown with every combination of the secondary features. It will be appreciated, however, that each shape of the blade guards may incorporate the various secondary features such as tethers and flotation devices as shown in the other figures.

Figure 6:
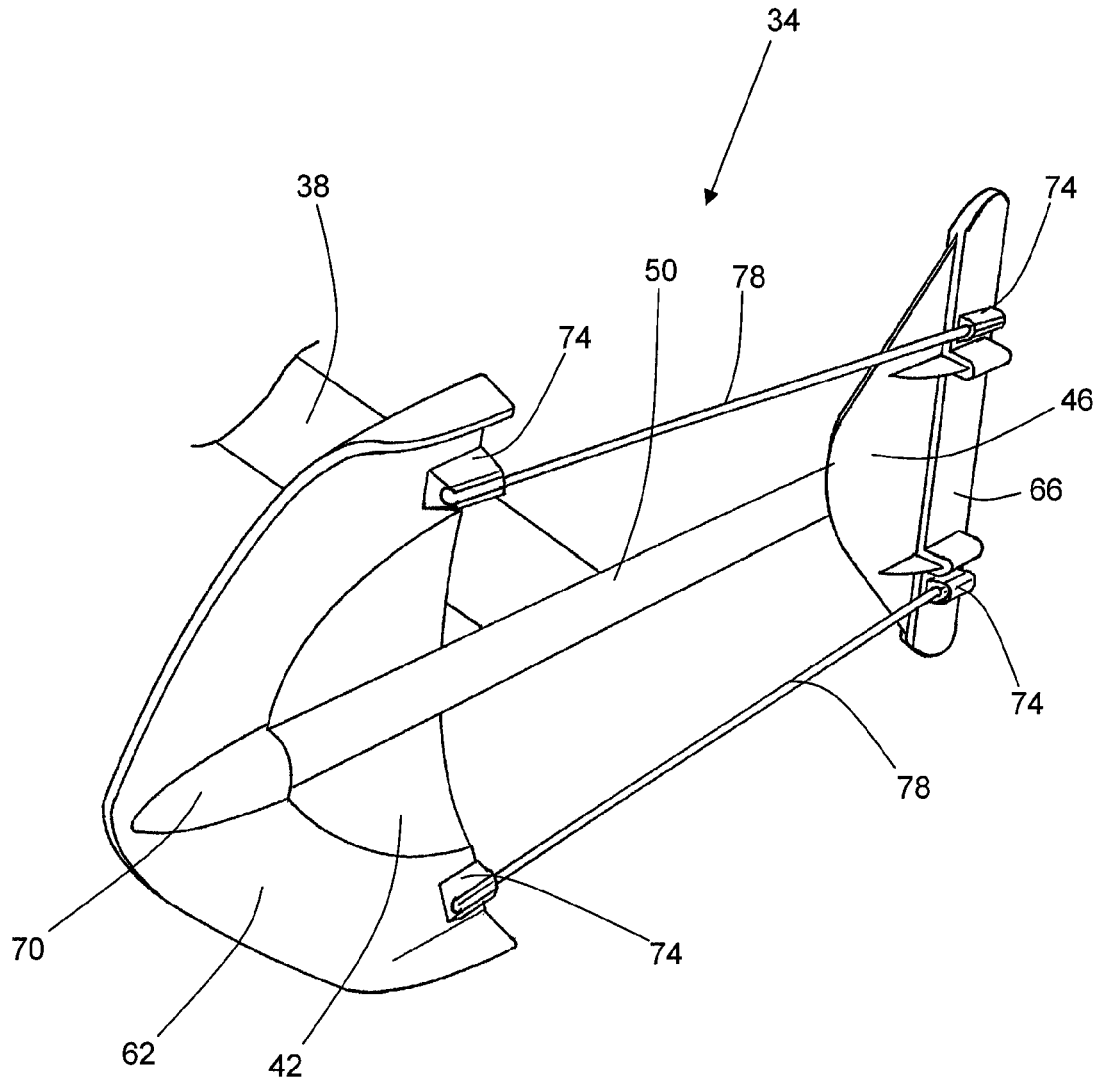
FIG. 6 shows another perspective view of the device of FIG. 1 having guards according to the present invention.

Turning now to FIG. 6, another perspective view of the hydrofoil portion 34 of the hydrofoil watersports device 10 is shown. The front foil guard 62 may include a bump or raised portion 70 to cover the end of the beam 50. If desired, the front guard 62 and rear guard 66 may include brackets 74 which allow a bungee cord or elastic cord 78 to be stretched therebetween to secure the guards to the foils, or hydrofoil blades, 42, 46 and to also prevent accidental contact with the inner portions of the foils. It can be seen how the cords 78 extend between the front guard 62 and rear guard 66. The brackets 74 and elastic cords 78 may not be necessary, as the guards 62, 66 may be made to stretch or wrap around the corners of the foils 42, 46 and thus be secured in place.

Figure 7:
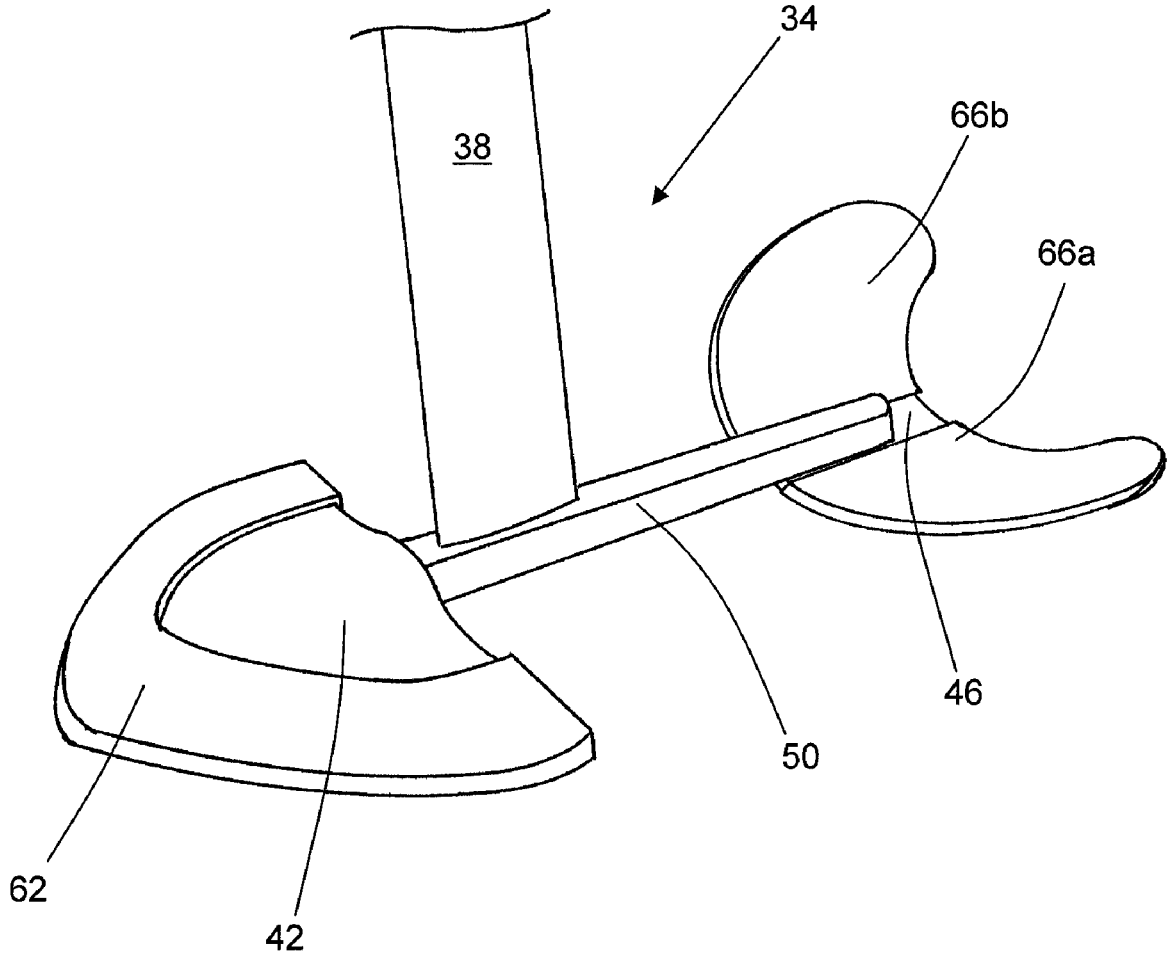
FIG. 7 shows another perspective view of the device of FIG. 1 having an alternate rear foil and having guards according to the present invention.
Figure 8:
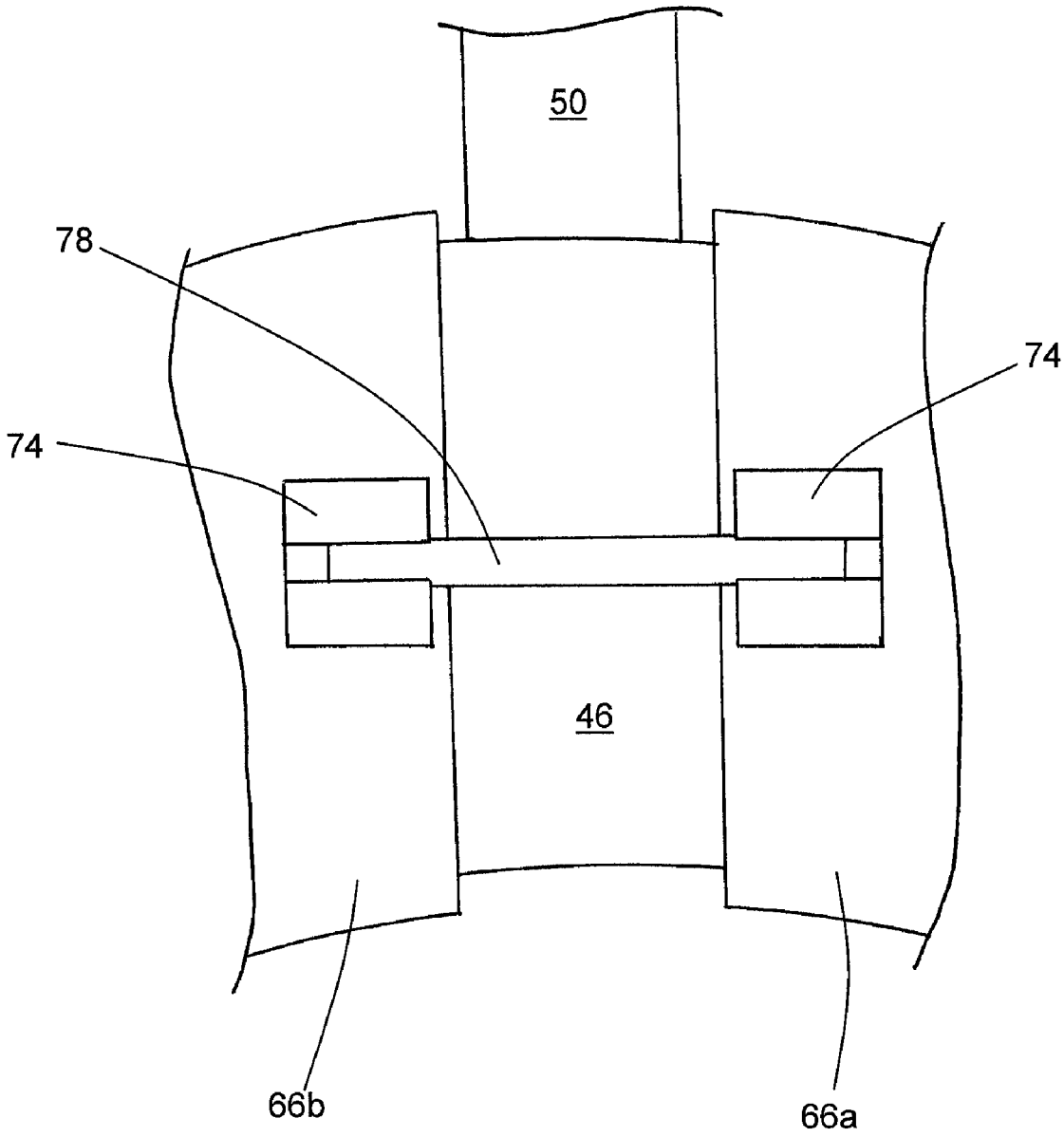
FIG. 8 shows a detail view of the rear guards of FIG. 7.

Turning now to FIG. 7, the hydrofoil portion 34 is shown with the rear foil, or rear hydrofoil blade, 46 of FIGS. 1 and 3. The front guard 62 may be similar to those shown previously. The rear guard may include a first half 66*a* and a second half 66*b* which each fit over one of the two halves of the rear foil, or hydrofoil blade, 46, as it may be difficult to install a single piece guard which adequately covers the rear foil, or hydrofoil blade, 46. It can be seen how the rear guard is generally crescent shaped front to back and curved top to bottom. FIG. 8 illustrates how brackets 74 and elastics or cords 78 may be used to hold the guard halves 66*a*, 66*b* together if desired.

It is thus appreciated that, according to the present invention, any of the guards shown herein may include brackets 74 and elastics or cords 78 to more securely hold the guards to the foils 42, 46. In some cases, the elastics or cords 78 may not be used when the guards are placed on the hydrofoil blades 42, 46 between uses of the hydrofoil chair 10 (i.e. when the guards are in place while the chair is in a boat between rides) but may be desirable when the chair is to be stored for a longer period of time.

Figure 9:
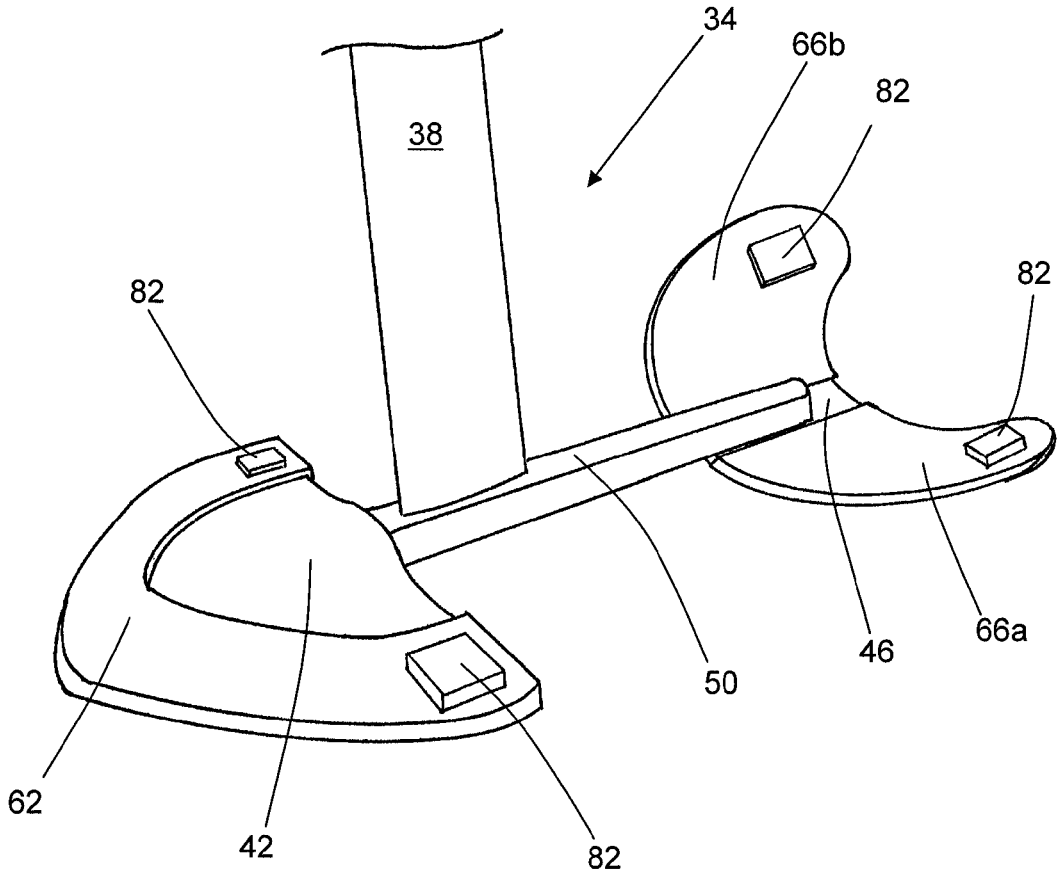
FIG. 9 shows a perspective view of the device of FIG. 7 having guards according to the present invention.

Turning now to FIG. 9, a perspective view of the hydrofoil portion 34 and guards 62 and 66 of FIG. 7 are shown. The guards 62, 66 may include flotation devices 82. The flotation devices 82 may be attached to or formed integrally with the guards 62, 66. The flotation devices 82 may be a closed cell foam, hollow plastic or rubber, etc., or may even be an air pocket formed into the guard 62, 66. As the guards 62, 66 are often used while boating, the guards may accidentally fall into the water. Loss of the guards 62, 66 is prevented by making the guards float in water.

Figure 10:
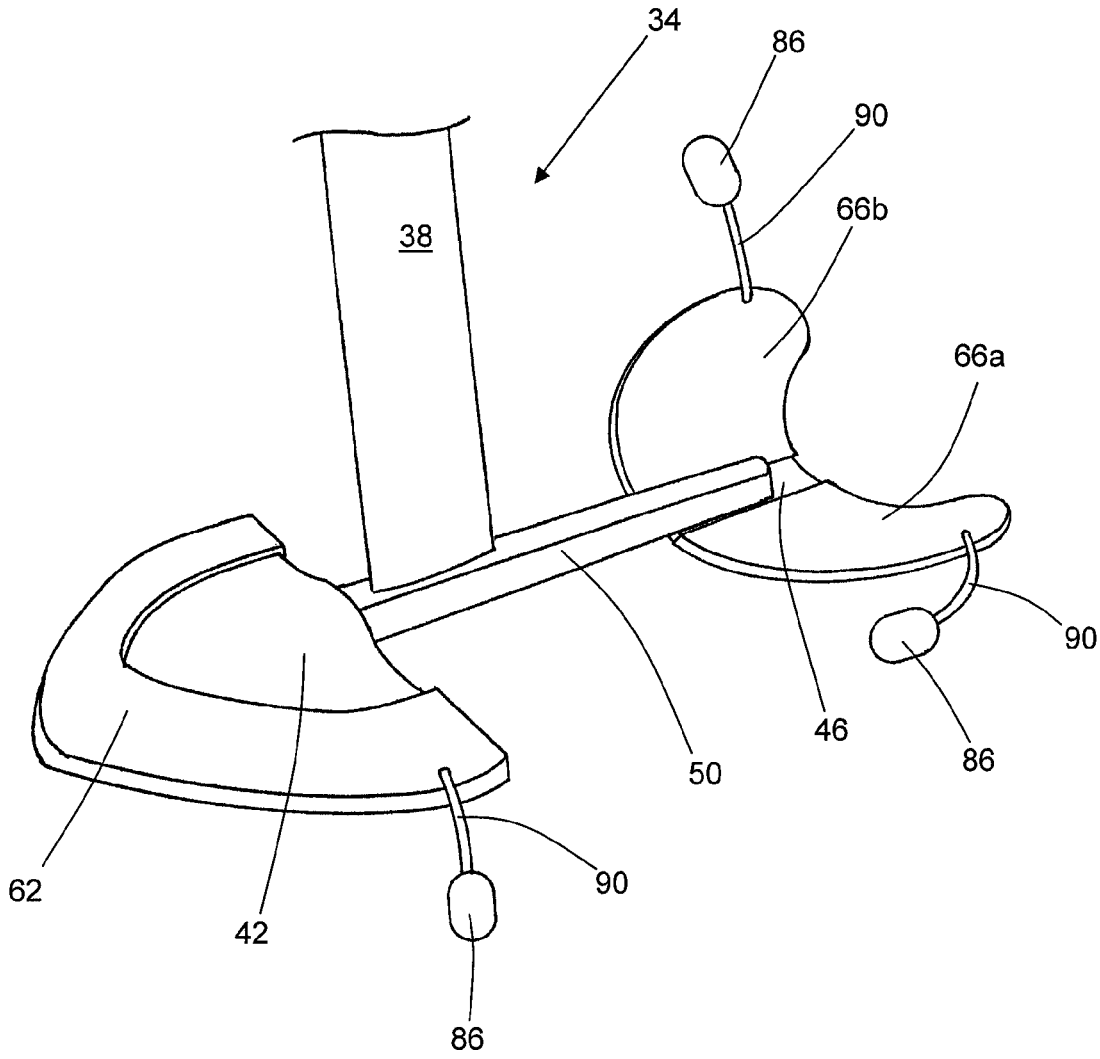
FIG. 10 shows another perspective view of the device of FIG. 7 having guards according to the present invention.

Turning now to FIG. 10, another perspective view of the hydrofoil portion 34 and guards 62 and 66 of FIG. 7 are shown. It can be seen how flotation devices 86 (such as hollow plastic or rubber objects or blocks of closed cell foam) may be attached to the guards 62, 66 via tethers 90. Flotation devices 82, 86 as shown are advantageous as they will prevent the guards 62, 66 from sinking if they are dropped in the lake when the hydrofoil chair 10 is in use. Many times, a person will desire to enter the water with the guards 62, 66 still on the foils 42, 46 so as to not injure themselves or damage their boat while mounting the chair 10 or moving the chair into or out of the boat. The person would then remove the guards while in the water and before using the device. Guards 62, 66 which float will eliminate concerns that the person is not able to remove the guards and place them in the boat without incident once in the water. Any of the various guards 62, 66 of the present invention may include the flotation devices shown in FIGS. 9 and 10.

Additionally, the material used to form the guards 62, 66 may be made to float. Typically, the guards 62, 66 are made of a flexible material, such as a silicone, urethane, rubber, etc. so as to be stretchable and bendable when installing the guards over the foils 42, 46. Such a material may be advantageously used to make a guard 62, 66 which is stretched over the corners of the foils 42, 46 to thereby provide a securely fitting guard which will not accidentally fall off of the foils 42, 46. In order to provide flotation, an amount of a low density material such as hollow glass or plastic microspheres may be mixed into the material used to make the material have a density less than that of water.

Figure 11:
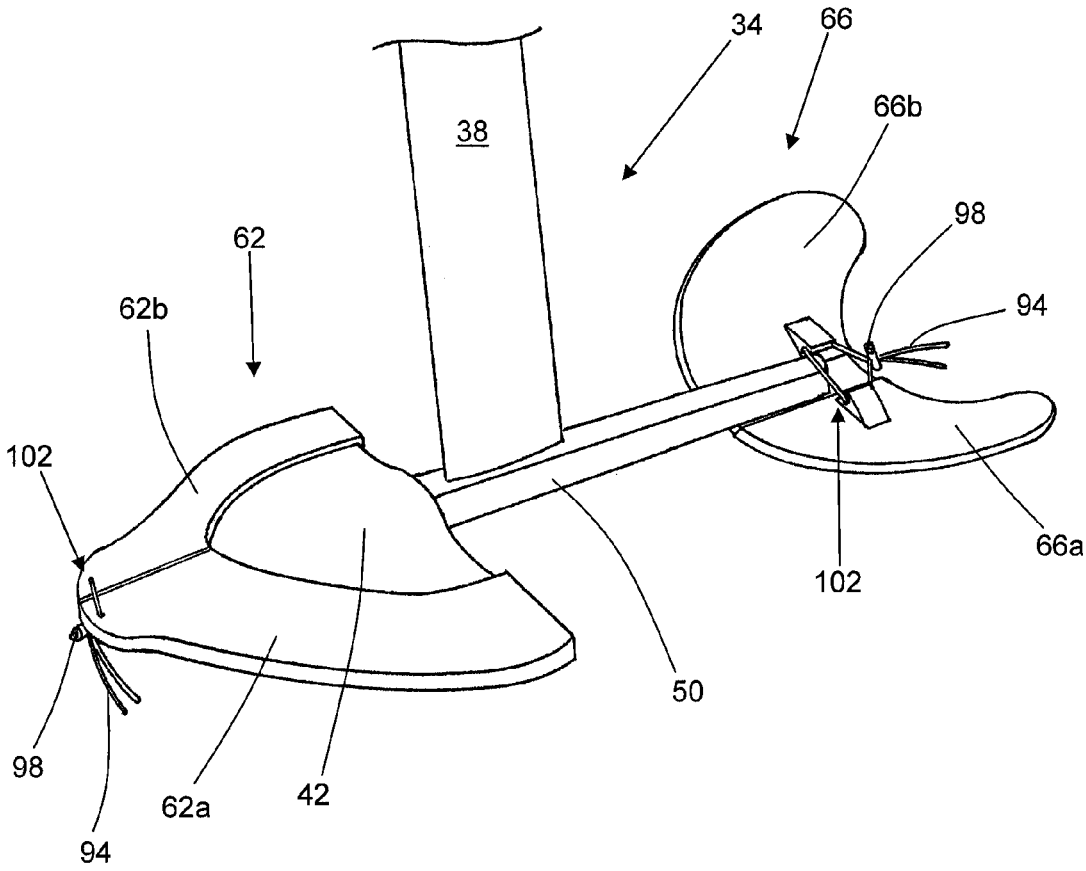
FIG. 11 shows another perspective view of the device of FIG. 7 having guards of the present invention.

Turning now to FIG. 11, another perspective view of the hydrofoil portion 34 and guards 62 and 66 of FIG. 7 are shown. As discussed, the rear guard may include a first half 66*a* and a second half 66*b* which each fit over one of the two halves of the rear foil 46, as it may be difficult to install a single piece guard which adequately covers the rear foil 46. Similarly, the front guard 62 may include a first half 62*a* and a second half 62*b* to make the guard easier to install on the foil 42. A cord 94 and pinch clips 98 may be used to connect the two halves together. The cord 94 passes through holes 102 formed in the guards. The pinch clips 98 allow the cords to be loosened or tightened to allow the guards to be removed from the foils or secured to the foils.

There is thus disclosed an improved foil guard for sporting devices which include hydrofoils. It will be appreciated that numerous changes may be made to the present invention without departing from the scope of the claims.

What is claimed is:

1. A hydrofoil blade guard for covering the hydrofoil blades of a hydrofoil watersports device, the hydrofoil watersports device having a front hydrofoil blade, a rear hydrofoil blade, a body connecting the front hydrofoil blade to the rear hydrofoil blade, and a recess for receiving a person's foot to allow said person to ride the hydrofoil watersports device while being pulled by a boat, wherein the guard comprises:

a front guard removably attached to the front hydrofoil blade to selectively cover an outer edge of and a portion of the top surface and a portion of the bottom surface of the front hydrofoil blade and a rear guard removably attached to the rear hydrofoil blade to selectively cover an outer edge of and a portion of the top surface and a portion of the bottom surface of the rear hydrofoil blade of the hydrofoil device.

2. The guard of claim 1, wherein the guard is formed of an elastomeric material so as to be stretchable around the hydrofoil blades.

3. The guard of claim 1, wherein the guard further comprises a flotation device so as to float in water.

4. The guard of claim 3, wherein the guard is formed of two pieces, and wherein the guard further comprises a tether for attaching the two pieces together.

5. The guard of claim 1, wherein the front guard covers the forward facing edges of the front hydrofoil blade and wherein the rear guard covers the rearward facing edges of the rear hydrofoil blade, and further comprising cords connecting the front guard to the rear guard.

6. The guard of claim 5, wherein the front guard is generally V shaped and wherein the rear guard is generally straight.

7. The guard of claim 1, wherein the rear guard is formed of two separate pieces, each of the two pieces being configured for covering one side of the rear hydrofoil blade, and wherein the rear guard is generally crescent shaped front to back and curved top to bottom.

8. The guard of claim 7, further comprising a cord for connecting said two rear guard pieces together.

9. The guard of claim 7, wherein the front guard is formed of two separate pieces, each of the two pieces being configured for covering one side of the front hydrofoil blade.

10. A system comprising a hydrofoil sporting device and a hydrofoil blade guard for said hydrofoil sporting device, the hydrofoil sporting device comprising a front hydrofoil blade and a rear hydrofoil blade, a beam connecting the front hydrofoil blade to the rear hydrofoil blade, a post extending upwardly from the beam, and a recess for receiving a person's foot to thereby allow said person to ride the hydrofoil sporting device, the hydrofoil blade guard comprising:

a front guard removably attached to the front hydrofoil blade to cover an outer edge portion the front hydrofoil blade, a portion of the bottom surface of the front hydrofoil blade which is adjacent said edge portion, and a portion of the top surface of the front hydrofoil blade which is adjacent said edge portion, and wherein the front guard is generally V shaped and covers the front and side edges of the front hydrofoil blade, and a rear guard removably attached to the rear hydrofoil blade to cover an outer edge portion of the rear hydrofoil blade, a portion of the bottom surface of the rear hydrofoil blade which is adjacent said edge portion, and a portion of the top surface of the rear hydrofoil blade which is adjacent said edge portion, and wherein the front guard is disposed to cover the front hydrofoil blade and the rear guard is disposed to cover the rear hydrofoil blade, and wherein the front and rear hydrofoil blade guards are removed during use of the hydrofoil sporting device.

11. The system of claim 10, wherein the rear guard is generally straight and covers the rear edge of the rear hydrofoil blade.

12. The system of claim 11, wherein the front guard is connected to the rear guard by cords.

13. A hydrofoil blade guard configured for covering the hydrofoil blades of a hydrofoil sporting device, the hydrofoil sporting device comprising:

a front hydrofoil blade;

a rear hydrofoil blade;

a beam connecting the front hydrofoil blade to the rear hydrofoil blade so as to space the front hydrofoil blade longitudinally from the rear hydrofoil blade;

a post extending upwardly from the beam; and a seat for allowing a person to ride the hydrofoil sporting device while being pulled by a boat;

wherein the hydrofoil blade guard comprises:

a front hydrofoil blade guard removably attached to the front hydrofoil blade so as to cover outer edges of the front hydrofoil blade and a portion of the top and bottom surfaces of the front hydrofoil blade adjacent said outer edges, the front guard being generally V shaped and covering the front and side edges of the front hydrofoil blade; and a rear hydrofoil blade guard removably attached to the rear hydrofoil blade so as to cover outer edges of the rear hydrofoil blade and a portion of the top and bottom surfaces of the rear hydrofoil blade adjacent said outer edges.

14. The guard of claim 13, wherein the front guard and the rear guard float in water.

15. The guard of claim 13, wherein the front guard is formed of two separate pieces, and wherein each of the two separate pieces is configured for covering one side of the front hydrofoil blade, and further comprising a tether for attaching the two pieces of the front guard together.

16. The guard of claim 15, wherein the rear guard is formed of two separate pieces and wherein the rear guard is generally crescent shaped.

17. The guard of claim 13, wherein the rear guard is generally straight and covers the rear edge of the rear hydrofoil blade.

18. The guard of claim 13, wherein said front hydrofoil blade guard receives said outer edges of the front hydrofoil blade and extends inwardly beyond said outer edges to cover a portion of said blade, and wherein said rear hydrofoil blade guard receives said outer edges of the rear hydrofoil blade and extends inwardly beyond said outer edges to cover a portion of said blade.

19. The guard of claim 1, wherein the guard extends inwardly beyond said outer edges of the front and rear hydrofoil blades to cover a portion of said blades.

20. The guard of claim 10, wherein the front hydrofoil blade guard extends inwardly past said outer edge portion to cover a portion of said front hydrofoil blade, and wherein the rear hydrofoil blade guard extends inwardly past said outer edge portion to cover a portion of said rear hydrofoil blade.

* * * * *